US007867428B2

(12) United States Patent
Filippini

(10) Patent No.: US 7,867,428 B2
(45) Date of Patent: Jan. 11, 2011

(54) METHOD OF MAKING A COMPOSITE RACQUET

(75) Inventor: Rafael G. Filippini, Bonita, CA (US)

(73) Assignee: Gear Box, Bonita, CA (US)

( * ) Notice: Subject to any disclaimer, the term of this patent is extended or adjusted under 35 U.S.C. 154(b) by 538 days.

(21) Appl. No.: 11/737,341

(22) Filed: Apr. 19, 2007

(65) Prior Publication Data

US 2008/0261733 A1 Oct. 23, 2008

(51) Int. Cl.

| | |
|---|---|
| ***B28B 7/32*** | (2006.01) |
| ***B28B 5/00*** | (2006.01) |
| ***B28B 3/00*** | (2006.01) |
| ***B27N 3/10*** | (2006.01) |
| ***B29C 45/14*** | (2006.01) |
| ***B29C 59/02*** | (2006.01) |
| ***B29C 43/00*** | (2006.01) |
| *A63B 49/00* | (2006.01) |
| *A63B 49/02* | (2006.01) |
| *A63B 49/10* | (2006.01) |

(52) U.S. Cl. ..... 264/314; 264/257; 264/250; 264/320; 264/325; 264/319; 473/524; 473/535

(58) Field of Classification Search ..... None
See application file for complete search history.

(56) References Cited

U.S. PATENT DOCUMENTS

| | | | | |
|---|---|---|---|---|
| 4,264,389 | A * | 4/1981 | Staub et al. | 156/156 |
| 5,009,422 | A | 4/1991 | Soong | |
| 5,234,657 | A * | 8/1993 | Hong | 264/516 |
| 5,762,571 | A | 6/1998 | DeGaris | |
| 5,913,740 | A | 6/1999 | Miklos | |
| 2005/0266940 | A1 | 12/2005 | Filippini | |

* cited by examiner

*Primary Examiner*—Christina Johnson
*Assistant Examiner*—Benjamin Schiffman
(74) *Attorney, Agent, or Firm*—Stephen C. Beuerle; Procopio Cory Hargreaves & Savitch LLP

(57) ABSTRACT

A composite sports racquet frame including a frame made of composite material, the frame including a head portion configured to receive and surround a string bed with a plurality of string segments, and a handle portion. The head portion includes a tip section on an opposite end of the frame from the handle portion, and the tip section includes a solid cross-section substantially throughout and the remainder of the head portion includes a hollow cross-section substantially throughout.

10 Claims, 2 Drawing Sheets

METHOD OF MAKING A COMPOSITE RACQUET

FIELD OF THE INVENTION

The present invention relates to sports racquets and methods of manufacturing sports racquets.

BACKGROUND OF THE INVENTION

Sports racquets (e.g., tennis rackets, squash racquets, badminton racquets, racquetball racquets) include a frame with a head portion. Strings are strung across the head portion of the frame to form a string bed. The head portion surrounds and defines the string bed. During play (e.g., tennis, squash, badminton, racquetball), the string bed is designed to contact and rebound a game piece such as a shuttlecock, racquetball or tennis ball.

Traditionally, the frames of sports racquets were made of wood. More recently, the frames have been made of extruded aluminum and composite materials.

Extruded racquet frames typically consist of aluminum alloy materials. Due to the ease of manufacturing these extruded structures, extruded racquet frames are preferred when producing low-price, mass-production frames. However, extruded aluminum racquet frames have many limitations, mostly due to the extruded process itself. These frame structures cannot be manipulated to increase strength, stiffness, or to change the extruded shape to create variable size frame section or wall thickness variability. Additionally, aluminum alloys are heavy and lack strength when compared to advanced plastics products used in today's industry.

Currently, composite racquet frames are the preferred type of racquet frames by most racquet sports enthusiasts, mostly because of the high strength-to-weight ratio in composite racquet frames. A bladder and cavity molding process is the preferred method used in today's manufacturing process of composite racquet frames. Using bladder molding allows for additional customization of the racquet frame. Combining materials, such as, carbon, Kevlar, fiberglass, boron, and other fibrous materials, are used to create structures that can vary in strength, rigidity, and weight. The freedom of controlling the fibers within the racquet frame structures has advanced racquet sports in recent years. It also has allowed for racquets to become more rigid, lighter, and larger, thus improving the player's ability and advancing the evolution of each individual sport.

Bladder molding a racquet frame is a process where structure is created by using compressed air, chemical reactions to increase pressure, or hot gases to apply internal pressure within the structure, thus forcing the material to the predetermined edges of the mold shape. At the same time, when pressure is added to the structure, the mold and the part is heated to a temperature which that accelerates the catalyst process to harden the racquet structure. Once hardened, a rough cured racquet frame is created.

The first step in bladder molding is to prepare the part for the molding process. This step is called creating a "pre-shape." A pre-shape is a straight tube structure where later the part will be bent and formed into a shape that fits within the mold, known in the industry as a "hair pin". The pre-shape process first begins with the use of a rigid mandrel. The rigid mandrel is used to create a predetermined cross sectional shape. A nylon bladder then is placed over the mandrel. This nylon bladder is sealed to contain the air, chemical or hot gas pressure. Now having a rigid mandrel with the bladder in place a lay-up process begins. The lay-up process is the application of multiple plies of carbon, Kevlar, fiberglass, etc. along the mandrel. Once the lay-up is completed, the pre-shape is placed into a mold having a special design. The mold is closed, and air is supplied to the bladder, forcing the material to the predetermined edges of the mold shape. Simultaneously, the mold and the part is heated to a temperature that accelerates the catalyst process to harden the racquet structure. Once hardened, a rough cured racquet frame is created.

A problem with bladder molding is that it is designed to create a hollow racquet frame structure. Although this decreases the overall weight of the frame, there is a sacrifice in the dynamic strength and durability of the frame.

Another problem with bladder molding is that holes still need to be drilled through substantially all of the frame to attach the strings to the frame. Drilling holes through the frame cuts the fibers of the composite frame material, weakening the frame structure.

SUMMARY OF THE INVENTION

Accordingly, an aspect of the invention involves a composite sports racquet and method of manufacturing a composite sports racquet that provides a hollow and solid combination frame design to improve the dynamic strength of the frame without having to drill holes in substantially the entire frame, preventing the cutting of fibers and weakening of the frame structure.

In the method of manufacturing the composite sports racquet, bladder molding and compression molding are simultaneously combined to create a composite sports racquet frame with improvements in dynamic and static strength, reduced weight, and improvements to the variability in the frame structures. The combination of compression and bladder molding allows the frame structure to have improved dynamic strength only in the areas where a solid structure would improve the strength and reduce breakage due to impacts with other objects, such as, walls, racquets, floors, etc. In the sections where bladder molding occurs in the frame, sections are made in a traditional manner; however, in the sections where the frame is solid, the mold is designed to have special slides that move to create positive pressure within the cavity mold. In an alternative embodiment, in the solid sections of the frame, pre-molded holes are created, eliminating the need to drill holes that cut the fibers, hence weakening the structure.

Another aspect of the invention involves a composite sports racquet frame including a frame made of composite material, the frame including a head portion configured to receive and surround a string bed with a plurality of string segments, and a handle portion. The head portion includes a tip section on an opposite end of the frame from the handle portion, and the tip section includes a solid cross-section substantially throughout and the remainder of the head portion includes a hollow cross-section substantially throughout.

A further aspect of the invention involves a method of making a composite sports racquet frame including bladder molding a composite sports racquet frame having one or more hollow sections; and simultaneously compression molding one or more sections in the composite sports racquet frame having a solid cross-section substantially throughout.

A still further aspect of the invention involves a method of making a composite sports racquet frame including creating a composite sports racquet frame pre-shape; inserting the pre-shape into a mold; bladder molding a composite sports racquet frame having one or more hollow sections from the pre-shape in the mold; simultaneously compression molding one or more sections in the composite sports racquet frame having a solid cross-section substantially throughout from the pre-shape in the mold, and extracting the molded composite sports racquet frame from the mold.

DETAILED DESCRIPTION OF PREFERRED EMBODIMENTS

Figure 1:
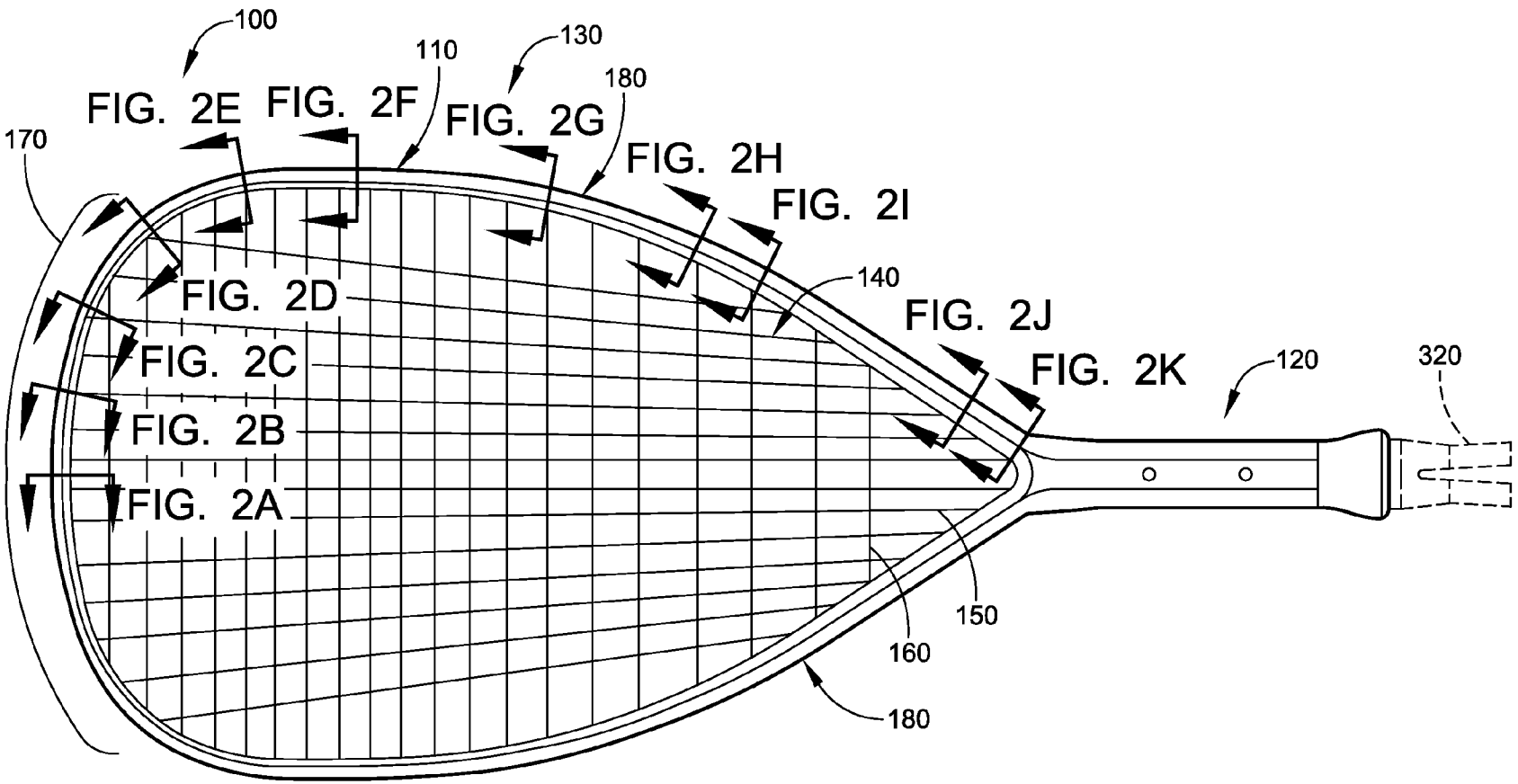
FIG. 1 is a top plan view of a composite sports racquet constructed in accordance with an embodiment of the invention.
Figure 2A:
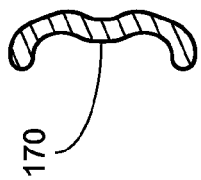
FIGS. 2A, 2B, 2C, 2D, 2E, 2F, 2G, 2H, 2I, 2J, and 2K are respective cross-sectional views taken along lines 2A-2A, 2B-2B, 2C-2C, 2D-2D, 2E-2E, 2F-2F, 2G-2G, 2H-2H, 2I-2I, 2J-2J, and 2K-2K of the composite sports racquet of FIG. 1.
Figure 2B:
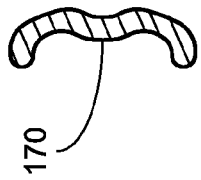
Figure 2C:
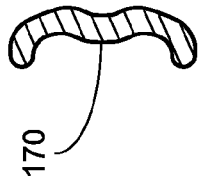
Figure 2D:
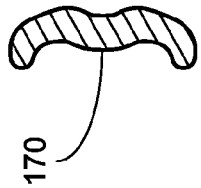
Figure 2E:
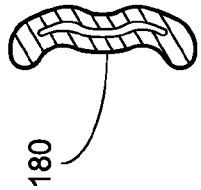
Figure 2F:
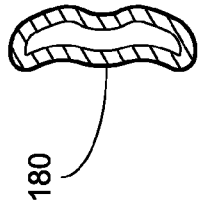
Figure 2G:
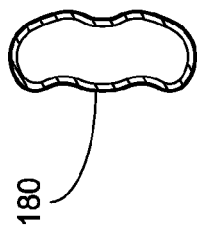
Figure 2H:
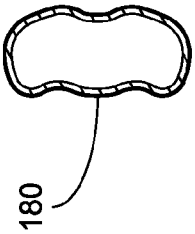
Figure 2I:
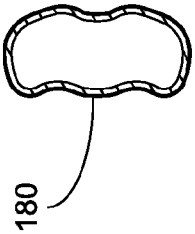
Figure 2J:
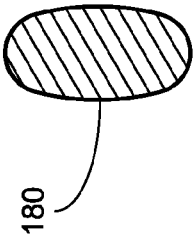
Figure 2K:
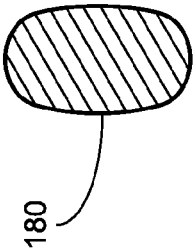
Figure 3:
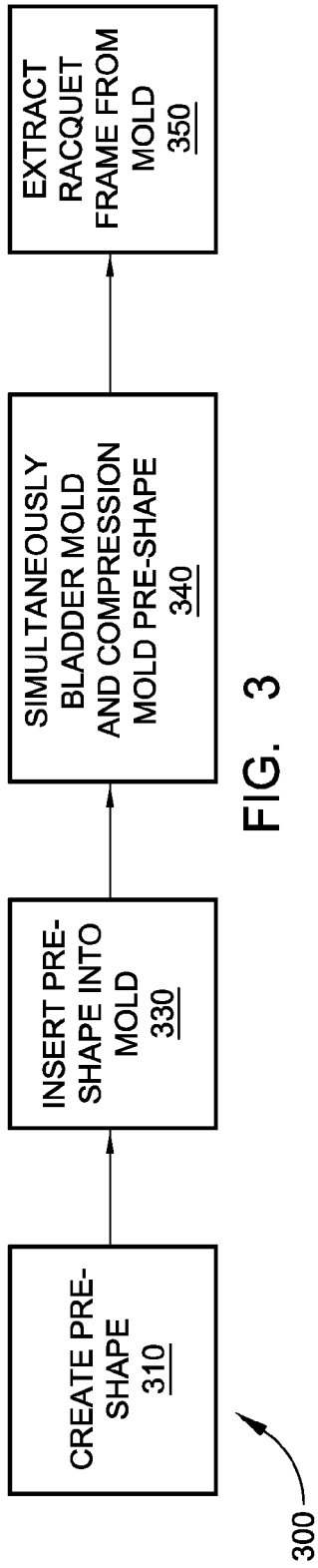
FIG. 3 is a flow chart of an exemplary method of making a composite sports racquet.

With reference to FIGS. 1-3, an embodiment of a fiber-reinforced composite sports racquet 100 and method of manufacturing the composite sports racquet 100 will be described. The composite sports racquet 100 provides a hollow and solid combination frame design to improve the dynamic strength of the frame without having to drill or press holes in a certain section or sections of the frame, preventing the cutting of fibers and weakening of the frame structure. Although the composite sports racquet 100 will be shown in conjunction with a racquetball racquet, the composite sports racquet 100 and method of manufacturing apply to other composite sports racquets such as, but not by way of limitation, tennis rackets, squash racquets, and badminton racquets.

The composite sports racquet 100 includes a frame 110 having a handle portion 120 and a head portion 130. The head portion 130 defines and surrounds a string bed 140. The string bed 140 is composed of a plurality of long, main, or substantially vertical strings 150 and a plurality of cross, lateral or horizontal strings 160 which are disposed at substantially right angles to main strings 150. The head portion 130 includes a tip section 170 (extending from substantially a 10 p.m. to a 2 p.m. position) in a distal part of the head portion 130 on an opposite end of the frame 110 from the handle portion 120. The tip section 170 is a part of the composite sports racquet 100 susceptible to damage or breakage due to impacts with other objects, such as, walls, racquets, floors, etc. Thus, the tip section 170 of the frame 110 includes a solid section (FIGS. 2A-2D) whereas substantially the remainder of the frame 110 of the head portion 130 includes hollow sections 180 (FIG. 2E-2K), where damage or breakage due to impacts is not an issue. As illustrated in FIG. 2E and 2F, there is a transition between the completely solid cross-section at the tip section 170 (FIG. 2A to 2D) and the hollow sections 180 (FIG. 2G, 2H and 2I), in which the hollow interior starts to be formed and increases in size from FIG. E through FIGS. 2F and 2G. Although the tip section 170 is shown as a single section in the frame 110 having a solid cross-section, in alternative embodiments, one or more sections in the frame 110 have a solid cross-section.

With reference to FIGS. 3, an exemplary method 300 of manufacturing a composite sports racquet 100 will be described. At step 310, a pre-shape is created. A pre-shape is a straight tube structure where later this straight tube structure is bent and formed into a shape that fits within the mold. The pre-shape process first begins with providing two elongated rigid mandrels having a predetermined cross sectional shape. The mandrels are rigid structures that assist in creating the pre-shape. In alternative embodiments, the mandrels are made of wood, plastic, or metal. Each mandrel provides a rigid form that the graphite plies are wrapped around. The main purpose of the mandrel is to help determine the circumference of the finished racquet frame. Respective elongated nylon bladders are placed or disposed over the mandrels. The bladders are sleeves that are placed between the mandrel and the graphite plies, and serve two purposes: 1) to provide a non-porous, air tight, bladder which is used to blow the racquet once inside the cavity mold; and 2) to help remove the mandrel once all of the graphite material has been rolled around to create the raw frame. The shape of bladders is very similar to that of a hose, and the thickness of the bladder wall is roughly 0.010". The bladders are made of a clear nylon material. The bladders slide onto the mandrels. These nylon bladders include open proximal ends/inlets 320 (FIG. 1) that are configured to be connected to a source for inflating the respective bladders with air, chemical or hot gas pressure during the molding step and opposite sealed distal ends to contain the air, chemical or hot gas pressure transmitted to the nylon bladder during the molding step. The elongated mandrels with bladders thereon are aligned substantially distal end to distal end with the distal ends separated from each by a gap of a predetermined distance. The distal ends of the elongated mandrels with bladders are connected by a solid connection section including rapped or layed-up plies of graphite impregnated with an epoxy resin. The plies in the solid connection section are different-angled plies. The various angles used in a composite construction are used to control stiffness, bending, torsion, and to enhance playability in the racquet frame. The nature of having a continuous fibrous construction is precisely being able to control the tubes bending, torsion, and stiffness at determined locations. With these composite structures, graphite and other like materials are used to maximize the effectiveness of the structure. For example, the flex points at a very specific and predetermined areas along the racquet's frame can be changed. Having a Zero-Degree orientation along the longitudinal axis of the racquet frame provides the stiffest possible tube. On the other hand, by having material at right angles to the longitudinal axis, a very flexible racquet along the longitudinal axis is created. So, by combining angles between zero (0) degrees and ninety (90) degrees, each individual structure can be manipulated. The lay-up process then begins for the two aligned and connected (via solid connection section) elongated mandrels with bladders. The lay-up process is the application of multiple plies of carbon with epoxy resin along the outside of the bladders. The plies in this lay-up process are also different-angled plies. Once the lay-up is completed, the elongated mandrels are removed from the lay-up and the elongated pre-shape is placed into/onto the recess of another mandrel having the rough shape of a sports racquet (FIG. 1). Opposite proximal portions of the lay-up come together in the area of what will be come the handle portion 120. These opposite proximal portions of the lay-up are wrapped with multiple plies of carbon with epoxy resin to form the pre-shape handle portion. The open proximal ends/inlets 320 (FIG. 1) of the nylon bladders extend beyond the area of the pre-shape handle portion.

Before inserting the pre-shape into the mold, one or more slides are provided in the section of the mold members configured to receive the connection portion (corresponding to solid tip section 170). In the embodiment described herein, three slides are provided in the section of the mold members configured to receive the connection portion. In alternative embodiments, other numbers of slides (e.g., 1, 2, 4, 5, etc.) are provided in the section of the mold members configured to receive the connection portion. In a further embodiment, the one or more slides include pins for creating holes in the connection portion (solid tip section 170) for connecting the strings to the solid tip section 170.

At step 330, the pre-shape is inserted into a corresponding cavity in one of the mold members of the mold. The connection portion (corresponding to solid tip section 170) is inserted in a corresponding cavity section of one of the mold members adjacent the slides. The mold members are then closed together by a press.

At step 340, the pre-shape is simultaneously bladder molded and compression molded to create the composite sports racquet frame 110. Air is supplied to the nylon bladders via the inlets 320, forcing the graphite and epoxy resin material to the predetermined edges of the mold shape. Simultaneously, the mold and the part is heated to 150 degrees C for 25 minutes. The graphite and epoxy resin react at 140 degrees C. As the graphite and epoxy resin melt and while in a liquid form, small blasts of air are blasted into the mold cavity. The press imparts approximately 50 tons of pressure to press the mold members together, and compress the connection portion against the one or more slides to form the solid tip section 170 having the solid cross-sectional shapes shown in FIGS. 2A-2D. In the embodiment where the one or more slides include pins (or pins are otherwise provided in the section of the mold receiving the connection portion), the melted graphite and epoxy resin surrounds the pins and the graphite fibers mold around the pins. The mold is cooled for 5 minutes to a temperature that accelerates the catalyst process to harden the racquet structure.

At step 350, the mold is opened, and the rough cured racquet frame 110 is extracted from the mold.

The ends including the inlets 320 are cut off and the rest of the rough cured racquet frame 110 is de-flashed.

The racquet frame 110 is then taken to a drill mold press and holes for the strings are drilled into the racquet frame 110.

A bumper guard with string holes is added to the tip section 170 and plastic grommet strips with holes are added to the sides of the head portion 130 of the racquet frame 110. The strings 150, 160, a grip, a handle cap, and any graphics are then added to the racquet frame 110 in a well-known manner.

Thus, in the aforementioned method of manufacturing the composite sports racquet, bladder molding and compression molding are combined to create a composite sports racquet frame with improvements in dynamic and static strength, reduced weight, and improvements to the variability in the composite sports racquet frame. The combination of compression and bladder molding allows the frame structure to have improved dynamic strength only in the areas where a solid structure would improve the strength and reduce breakage due to impacts with other objects, such as, walls, racquets, floors, etc. Creating pre-molded holes in the solid structure of the racquet frame eliminate the need to drill holes that cut the fibers, weakening the structure, in the solid structure.

While the particular devices and methods herein shown and described in detail are fully capable of attaining the above described objects of this invention, it is to be understood that the description and drawings presented herein represent presently preferred embodiments of the invention and are therefore representative of the subject matter which is broadly contemplated by the present invention. It is further understood that the scope of the present invention fully encompasses other embodiments that may become obvious to those skilled in the art having the benefit of this disclosure and that the scope of the present invention is accordingly limited by nothing other than the appended claims.

What is claimed is:

1. A method of making a composite sports racquet frame, comprising:

molding a composite sports racquet frame including a handle portion and a head portion, the head portion defining a peripheral portion of the frame configured to receive and surround a string bed with a plurality of string segments and including a tip portion on an opposite end of the frame from the handle portion;

molding of the frame comprising bladder molding one or more sections of the peripheral portion of the composite sports racquet frame to form one or more hollow sections;

simultaneously compression molding one or more sections of the peripheral portion of the composite sports racquet frame to form one or more solid sections which have a solid cross-section substantially throughout;

creating pre-molded holes in the one or more sections in the frame with a solid cross-section by placing pins in a mold cavity at spaced positions along the location of the one or more solid sections to be formed in the frame and compression molding the material forming the solid sections around the pins.

2. The method of claim 1, wherein molding the frame comprises bladder molding at least part of the head portion to form one or more hollow sections, and simultaneously compression molding at least the tip portion of the head portion with a solid cross-section substantially throughout.

3. The method of claim 2, wherein the solid tip section extends from substantially a 10 pm position to a 2 pm position on the head portion, where the center of the tip section comprises a 12 am or pm position.

4. The method of claim 1, wherein bladder molding and compression molding occur within a cavity mold, and the mold includes one or more movable slides where compression molding occurs in the cavity mold, and the method further includes providing the one or more movable slides in the cavity mold with the material to be compression molded prior to compression molding and imparting positive pressure within the cavity mold in the area of the mold adjacent the one or more movable slides during compression molding.

5. The method of claim 1, further comprising forming a transition section between each hollow section and adjacent solid section which has a hollow interior of decreasing size between the hollow section and adjacent solid section.

6. A method of making a composite sports racquet frame, comprising:

bladder molding one or more sections of the composite sports racquet frame to form one or more hollow sections;

simultaneously compression molding one or more solid sections in the composite sports racquet frame at one or more different locations along the frame from the one or more hollow sections and which have a solid cross-section substantially throughout; and creating pre-molded holes in the one or more sections in the frame with a solid cross-section by placing pins in a mold cavity at spaced positions along the location of the one or more solid sections to be formed in the frame prior to the step of simultaneously compression molding the one or more solid sections, compression molding the material forming the solid sections around the pins, and removing the pins in the one or more solid sections of the frame after compression molding to create the pre-molded holes in the one or more sections of the frame with a substantially completely solid cross-section apart from the pre-molded holes.

7. A method of making a composite sports racquet frame, comprising:

creating a composite sports racquet frame pre-shape;

inserting the pre-shape into a mold;

molding the pre-shape in the mold to form a composite sports racquet frame having a head portion with a periphery configured to receive and surround a string bed with a plurality of string segments and a handle portion extending from the head portion, the head portion including one or more solid portions extending along the periphery of the head portion which are of at least substantially completely solid cross-section and one or more hollow portions which are at one or more different locations about the periphery from the one or more solid portions and which are of hollow cross-section, the one or more solid portions including at least part of a tip portion on an opposite end of the frame from the handle portion and the hollow portions extending from opposite ends of the tip portion towards the handle portion;

creating pre-molded holes in the one or more sections in the frame with a solid cross-section by placing pins in a mold cavity at spaced positions along the location of the one or more solid sections to be formed in the frame and compression molding the material forming the solid sections around the pins;

the step of forming one or more hollow cross-section portions of the head portion comprising bladder molding one or more hollow sections from the pre-shape in the mold;

the step of forming one or more solid cross-section portions of the head portion comprising compression molding one or more sections in the composite sports racquet frame from the pre-shape in the mold simultaneously with bladder molding the one or more hollow sections, the one or more compression molded sections having a solid cross-section substantially throughout, and extracting the molded composite sports racquet frame from the mold.

8. The method of claim 7, wherein at least the tip section is compression molded with a solid cross-section substantially throughout.

9. The method of claim 7, further including removing the pins in the one or more sections in the frame with a solid cross-section after compression molding to create the pre-molded holes in the one or more sections in the frame with a solid cross-section.

10. The method of claim 7, wherein the mold includes one or more movable slides where compression molding occurs in the cavity mold, and the method further includes providing the one or more movable slides in the cavity mold with the material to be compression molded prior to compression molding and imparting positive pressure within the cavity mold in the area of the mold adjacent the one or more movable slides during compression molding.

* * * * *